US010874270B2

(12) United States Patent
Larsen et al.

(10) Patent No.: US 10,874,270 B2
(45) Date of Patent: Dec. 29, 2020

(54) MOTOR HOUSING WITH SILENCER FOR A VACUUM CLEANING DEVICE

(71) Applicant: Nilfisk A/S, Brøndby (DK)

(72) Inventors: Peter Nøhr Larsen, København (DK); Bilal Sahsah, København (DK)

(73) Assignee: Nilfisk A/S, Brøndby (DK)

( * ) Notice: Subject to any disclaimer, the term of this patent is extended or adjusted under 35 U.S.C. 154(b) by 248 days.

(21) Appl. No.: 15/999,251

(22) PCT Filed: Feb. 10, 2017

(86) PCT No.: PCT/DK2017/050034
§ 371 (c)(1),
(2) Date: Aug. 17, 2018

(87) PCT Pub. No.: WO2017/140319
PCT Pub. Date: Aug. 24, 2017

(65) Prior Publication Data

US 2019/0104899 A1 Apr. 11, 2019

(30) Foreign Application Priority Data

Feb. 19, 2016 (EP) ..... 16156575

(51) Int. Cl.
*A47L 9/00* (2006.01)
*A47L 9/22* (2006.01)
(Continued)

(52) U.S. Cl.
CPC ..... *A47L 9/0081* (2013.01); *A47L 9/22* (2013.01); *F04D 29/664* (2013.01); *A47L 5/362* (2013.01)

(58) Field of Classification Search
CPC ..... A47L 5/362; A47L 9/0081; A47L 9/22; F04D 29/664
See application file for complete search history.

(56) References Cited

U.S. PATENT DOCUMENTS 4,665,581 A * 5/1987 Oberdorfer ..... A47L 9/0081 15/326

FOREIGN PATENT DOCUMENTS

CA 2523454 A1 * 4/2007 ..... A47L 9/0081
CA 2523454 A1 4/2007
(Continued)

OTHER PUBLICATIONS

International Application No. PCT/DK2017/050034, International Search Report and Written Opinion dated May 16, 2017, 8 pgs.
(Continued)

*Primary Examiner* — Marc Carlson
(74) *Attorney, Agent, or Firm* — Schwegman Lundberg & Woessner, P.A.

(57) ABSTRACT

A compact motor housing for housing a motor and a blower of a cleaning device and with integrated air outlet silencing. The motor housing encloses a flow passage between a flow inlet and outlet. The housing has a blower chamber fluidically connected to the flow inlet, and via first and second outlet openings also fluidically connected to at least two parallel, preferably similar, silencer ducts each being arranged in an area limited by an angle of less than 90°, seen in a view parallel with the blower and motor axis. The silencer ducts each have at least one wall between the blower chamber and the external wall of the motor housing for causing at least one flow direction bend, so as to provide a noise attenuating effect. The areas occupied by the at least two silencer ducts are non-overlapping, seen in a view parallel with the blower and motor axis. With a circular blower chamber, a compact box shaped motor housing can be provided with corner volumes available for silencer ducts.

14 Claims, 8 Drawing Sheets

(51) Int. Cl.
*F04D 29/66* (2006.01)
*A47L 5/36* (2006.01)

(56) References Cited

FOREIGN PATENT DOCUMENTS

| | | | | | |
|---|---|---|---|---|---|
| CN | 101057763 | A | | 10/2007 | |
| CN | 101933785 | A | * | 1/2011 | |
| CN | 202851208 | U | * | 4/2013 | |
| CN | 202851208 | U | | 4/2013 | |
| CN | 104519779 | A | * | 4/2015 | ..... A47L 9/0081 |
| CN | 104519779 | A | | 4/2015 | |
| EP | 1731070 | A1 | * | 12/2006 | ..... A47L 9/0081 |
| EP | 1731070 | A1 | | 12/2006 | |
| WO | WO-2014/005586 | A1 | | 1/2014 | |
| WO | WO-2014005586 | A1 | * | 1/2014 | ..... A47L 9/0081 |

OTHER PUBLICATIONS

"Chinese Application Serial No. 201780012078.7, Search Report dated Apr. 26, 2020", 2 pgs.
"Chinese Application Serial No. 201780012078.7, Office Action dated May 20, 2020", w/ English Translation, 9 pgs.

* cited by examiner

MOTOR HOUSING WITH SILENCER FOR A VACUUM CLEANING DEVICE

This application is a U.S. National Stage Filing under 35 U.S.C. 371 from International Application No. PCT/DK2017/050034, filed on Feb. 10, 2017, and published as WO 2017/140319 A1 on Aug. 24, 2017, which claims the benefit of priority under 35 U.S.C. § 119 to European Patent Application No. 16156575.9, filed on Feb. 19, 2016, each of which is incorporated by reference herein in its entirety.

FIELD OF THE INVENTION

The present invention relates to the field of noise reduction of motor and blower noise in a cleaning device, e.g. a vacuum cleaning device, a floor cleaning device, or a high pressure cleaning device. More specifically, the invention provides a motor housing with an integrated silencer for reducing noise from a vacuum or suction motor for generating an air flow in a cleaning device.

BACKGROUND OF THE INVENTION

Units comprising a motor and a blower (fan) are commonly used in cleaning devices for generating an airflow. Examples are induction motors fitted with a cooling fan, which are used to drive the pump in high pressure washers and in powerful (>1 kW) vacuum cleaners for industrial applications. Widely spread units with motor and a blower/fan are vacuum motors. Vacuum motors rotate at high revolution speed typically larger than 10.000 RPM and give rise to very powerful noise. Vacuum motors are used in suction cleaning apparatuses such as vacuum cleaners, carpet extractors, floor and road sweepers, and scrubbing and drying devices.

Motor driven fans and blowers are power sources of flow generated noise. The noise is generated inside the fan or blower and propagates to the surroundings via the air outlet. In compact devices noise reduction or silencing, has to be compromised between overall size of the device, and pressure loss. Given the size of a motor and blower, the space available for silencing of noise from the blower and motor has to be utilized taking into account an acceptable pressure loss.

The principle of the silencer according to the invention is to provide an acoustic low pass filter, where only noise with frequencies above the resonance frequency of the filter is able to escape. The lower the resonance frequency of the filter the higher the noise reduction will be. The acoustic filter consists of a cavity with the noise source (motor fan and blower) followed by an outlet duct for noise (and air in this case). A low resonance frequency is obtained by a large cavity and a long and narrow outlet duct. In order to avoid pressure loss the outlet duct obviously has to have a certain cross section area. The challenge is to provide a long outlet duct in a relatively compact design.

WO 2014/005586 shows a silencer system for a vacuum motor, comprising a cavity and a serpentive air duct. However, due to its size, the silencer system is not suited for very compact cleaning device designs.

SUMMARY OF THE INVENTION

Thus, according to the above description, there is a need for a compact way of providing silencing of a motor system for a compact cleaning device, which preferably at the same time provides a high noise attenuation of noise from the blower in the air outlet of the cleaning device, and still further provides a low pressure loss. Even further, the silencing should be rather simple to manufacture in a low cost mass production.

In a first aspect, the invention provides a motor housing for housing a motor and a blower of a vacuum cleaning device, the motor housing comprising an external wall for enclosing a blower arranged to rotate around an axis, a motor for driving the blower, the blower being arranged to generate a fluid flow in a flow passage between an externally accessible flow inlet and an externally accessible flow outlet, wherein the flow passage comprises, seen in a view parallel with said axis, i.e. where the blower axis would be, if placed as intended in the motor housing:

a blower chamber for housing the blower, wherein the blower chamber has an opening fluidically connected to the externally accessible flow inlet, wherein the blower chamber further has separate first and second outlet openings, a first silencer duct fluidically connected to the first outlet opening of the blower chamber, wherein the first silencer duct is arranged in a first area limited by a first angle of less than 90° from the axis, wherein at least one wall between the blower chamber and the external wall of the motor housing serves to cause at least one flow direction bend, such as a bend of 90°-180°, and wherein the first silencer duct has a first outlet opening, and a second silencer duct fluidically connected to the second outlet opening of the blower chamber, wherein the second silencer duct is arranged in a second area limited by a second angle of less than 90° from the axis, wherein at least one wall between the blower chamber and the external wall of the motor housing serves to cause at least one flow direction bend, such as a bend of 90°-180°, and wherein the second silencer duct has a second outlet opening, wherein the first and second areas are non-overlapping.

Such motor housing is advantageous since it is possible to provide a compact motor housing which is capable of reducing noise from both the blower and the motor in a cleaning device. This is provided by the first and second silencer ducts being angularly limited to less than 90° extension, e.g. limited to such as 40°-89°, more preferably 50°-89°, such as 70°-89°, such as as 70°-89°, such as 60°-80°, and being non-overlapping. The external wall of the motor housing serves to encapsulate air-borne noise directly from the blower and motor, while the silencer ducts serve to attenuate noise from the externally accessible flow outlet, which is typically a dominating noise source in a cleaning device.

The invention is based on the insight that such design allows splitting air flow from the blower chamber into practically identical parallel silencer ducts angularly distributed around the blower chamber, allows a high utilization of total volume available for providing effective silencing, still with a rather low pressure loss. Especially, the first and second silencers can be accommodated in corners of a motor housing with a generally rectangular or square outer shape, seen in a view parallel with said axis. In this way, with the limited angular extension of the silencer ducts, the silencer ducts utilize a volume parallel with the blower axis, and thus occupy a minimum of space around the blower chamber. This further means that bottom and top part of the external wall of the motor housing can be used as outer bottom and top walls for the silencer ducts, thus further reducing the need for space and separate wall elements.

Especially, a compact design can be achieved, since the blower chamber, typically circular shaped, can be placed with its outer wall adjacent, or even integral with, the external wall of the motor housing, at least at one point forming a tangent to the blower chamber. Thus, in preferred compact embodiments, there is no air flow around the blower chamber, rather the air flow is preferably primarily parallel with the axis. Especially, the first and second outlet openings in the blower chamber are arranged in a top surface part of the motor housing, while the first and second outlet openings of the respective silencer ducts are arranged on a bottom part of the motor housing, e.g. on a bottom surface part of the external wall of the motor housing.

In a preferred embodiment, all four cornes of a square cross sectional area motor housing can be used to house identical silencer ducts. The external wall of the motor housing can serve as outer wall of the silencer ducts, thus reducing the necessary number of wall elements within the housing, thereby allowing an even more compact design. With the motor and blower placed in the blower chamber being placed in a central part of the motor housing, this allows a high utilization of a rather large total volume available for providing a high noise attenuation due to space available for several walls. It is understood that the 'at least one wall' may comprise several plane or curved walls arranged between the blower chamber and the external wall of the motor housing can be used to create noise attenuating labyrinths of bends in the air flow as well as a significant change in cross sectional area of the flow path to create effective silencing in resonator chambers.

Especially, walls may be provided which are parallel with the axis, so as to provide a labyrinth effect for flow in a direction perpendicular to the axis. Such design with walls only parallel with the axis provides a simple design which is rather easy to manufacture, e.g. by injection moulding in one single or two elements. However, it is to be understood that more complicated wall designs inside the silencer ducts may be preferred, e.g. including wall elements serving to cause air flow in a direction parallel with the axis. Further, walls can be used to create quarter wavelength resonators inside the first and second silencer ducts which, tuned to reduce tonal blower blade passage noise, typically tones with a frequency in the range 2-10 kHz.

Further, apart from the compact design and high noise attenuation possible, the motor housing can be implemented with rather simple elements which allows all interior parts of the motor housing to be manufactured as one single low cost mass production element, e.g. by injection moulding in a polymeric material, as known in the art. For smaller dimensions, the motor housing may be manufactured by injection moulding two separate elements which can then be assembled, e.g. one of such parts can be formed integrally, e.g. monolithically, with a part of the cleaning device for which the motor housing is intended, hereby possibly saving even further space in the device.

In the following preferred embodiments and features will be described.

In preferred embodiments, the motor housing comprises a third silencer duct fluidically connected to a third outlet opening of the blower chamber, wherein the third silencer duct is arranged in a third area limited by a third angle of less than 90° from the axis and non-overlapping with the first and second areas, wherein the third silencer duct has a third outlet opening. E.g. such embodiment can utilize three corners of a square shaped motor housing for silencer ducts.

Another preferred embodiment comprises a fourth silencer duct fluidically connected to a fourth outlet opening of the blower chamber, wherein the fourth silencer duct is arranged in a fourth area limited by a fourth angle of less than 90° from the axis and non-overlapping with the first, second and third areas, wherein the fourth silencer duct has a fourth outlet opening. In such embodiment, all four corners of a square shaped motor housing can be utilized for silencer ducts, if all four silencer ducts are identical or substantially identical and occupy most of the corners of the motor housing, preferably from bottom to top of the motor housing, seen in a direction of said axis.

Preferably, the first and second silencer ducts have similar or substantially similar configurations with respect to silencing. This provides the best siliencing effect with the flow split into two separate parallel silencer ducts.

Preferably, the motor housing has a general rectangular or substantially rectangular outer shape, seen in a view parallel with said axis. It is to be understood that other motor housing shapes may be preferred in special applications, so as to better utilize a given space available inside a device.

The blower chamber preferably has a circular or substantially circular shaped outer wall, seen in a view parallel with said axis, in which the first and second openings are arranged. This matches the shape of a radial blower, and with a circular blower chamber wall with a radius slightly larger than the blower radius, only a minimum of space is occupied for the blower chamber, thus leaving space available for the silencer ducts. Especially, seen in a view parallel with said axis, the blower chamber, e.g. circular shaped, may extend at least at one point to the external wall of the motor housing. In this way, the entire space around the blower chamber is miminimzed.

At least one of the at least one wall of each of the first and second silencer ducts preferably extends parallel with the axis. Such parallel wall part may be curved or plane or corrugated and configured to provide a noise attenuating flow labyrinth, preferably including sharp bends of 90°-180°, e.g. several. Especially, each of the first and second silencer ducts may comprise a plurality of separate parallel walls configured to provide a labyrinth, seen in a view parallel with said axis.

The externally accessible flow inlet is preferably arranged on a top surface part of the external wall of the motor housing, preferably so as to allow air to flow directly into the blower chamber. Especially, the externally accessible flow inlet opening may have a circular shape on a central part of the top surface part of the external wall of the motor housing. A water-tigt sealing between blower and motor can be used to prevent liquid from penetrating to the motor, thus allowing the motor housing to be used in cleaning devices arranged for suction of liquid.

The first and second outlet openings from the respective silencer ducts are preferably located at respective separate positions on the external wall of the motor housing, so as to constitute said externally accessible flow outlet. Especially, the first and second outlet openings may be arranged on a bottom surface part of the motor housing, or alternatively on a lower part of a side wall part of the external wall of the motor housing. However, if preferred these first and second outlet openings may be combined inside the motor housing to provide one single externally accessible flow outlet opening.

Preferably, the motor housing is designed to accommodate a motor and blower which rotate around one common axis, and that the motor housing has at least a part of its external wall elements parallel with said axis.

Preferably, a first part of the external wall of the motor housing forms part of the first silencer duct, and wherein a second part of the external wall of the motor housing forms part of the second silencer duct. Hereby, the space available within the motor housing is utilized for the silencer ducts, and separate outer wall elements for enclosing the silencer ducts can be avoided, thus saving space and reducing the complexity of the motor housing with respect to manufacturing. Especially, the first and second silencer ducts are enclosed both in a direction perpendicular to said axis and in both directions parallel with said axis.

In a preferred embodiment, the motor housing is constituted by first and second separate polymeric elements arranged for being assembled. Preferably, the first element comprises a top surface part of the external wall of the motor housing and said at least one wall of both of the first and second silencer ducts. This is advantageous, since in version with small dimensions, it allows wall elements in the silencer ducts which are rather narrow and thus not possible to injection mould in one single element, however manufacturing the first element comprising these wall elements, the second element can be designed for being injection moulded in one single element. Especially, the first and second polymeric elements may be monolithically injection moulded or 3D printed elements. A preferred polymer material may be such as: Polypropylene (PP) or Acrylonitrile Butadiene Styrene (ABS). Especially, the first separate polymeric element may be monolithically formed or integrated with a part of a structure forming part of a cleaning device in which the motor is used.

Preferably, said wall between the blower chamber and the external wall of the motor housing of both of the first and second silencer ducts serve to cause a flow direction bend of 90°-180°, preferably a bend of 180° or at least such as a bend of 150°-180°. As mentioned, each silencer duct may comprise several wall elements arranged to provide a labyrinth between the blower chamber and the external wall of the motor housing.

Preferably, both of the first and second silencer ducts comprise at least one wall element dimensioned to act as a quarter wavelength resonator to reduce tonal noise from the blower, such as known within noise control engineering. This is typically a dominating noise in the air outlet of a cleaning device with a normally used AC or DC type electric motor and blower unit. This noise is typically tonal noise with one or more tones in the frequency range 2-10 kHz, especially around 3-6 kHz where the human ear has a high sensitivity. Especially, the at least one wall may be configured to provide a bend with dimensions corresponding to a quarter wavelength of the blade passage frequency of the blower when operated at a nominal rotation speed. Especially, a plurality of wall elements of each of the first and second silencer ducts serve to provide respective quarter wavelength resonators dimensioned to attenuate noise at the same quarter wavelength.

Preferably, both of the first and second silencer ducts extend, in a direction along said axis, from the bottom to the top of the motor housing. This allow the external wall of the motor housing to be used for enclosing top and bottom of the silencer ducts, and further utilize the total height of the motor housing as silencer duct volume.

A sound absorbing material (e.g. materials with a sound absorbtion coefficient of at least 0.2, such as at least 0.5) may be arranged within the housing to improve sound absorption within the silencer ducts, however it may be preferred to avoid such porous materials, especially in wet applications. It is appreciated that the silencer ducts according to preferred embodiments of the invention allows a high noise attenuation effect even without the use of any sound absorbing materials which can thus be eliminated in many applications.

The motor housing preferably comprises a separate cooling inlet and outlet for cooling the motor, e.g. both of the cooling inlet and outlet being arranged on a bottom surface of the external wall of the motor housing. Especially, the motor may have a separate cooling fan to drive cooling air between cooling inlet and outlet to cool the motor.

In a second aspect, the invention provides a cleaning device for generating a vacuum or a high pressure for cleaning dirt, comprising a motor housing according to the first aspect. Especially, the cleaning device comprises a blower and a motor arranged inside the motor housing and with an air outlet fluidically connected to the externally accessible flow outlet of the motor housing, and with an air inlet fluidically connected to the externally accessible flow inlet of the motor housing.

The cleaning device may be a vacuum cleaning device, e.g. a dry or wet vacuum cleaner, such as a household vacuum cleaning device, or it may be a floor cleaning device comprising a suction system, or it may be a high pressure cleaning device.

In a third aspect, the invention provides a method for manufacturing the motor housing according to the first aspect, the method comprising manufacturing, such as by injection moulding, a first polymeric element comprising motor a top surface part of the external wall of the motor housing and said at least one wall between the blower chamber and the external wall of the motor housing of both of the first and second silencer ducts, and manufacturing, such as by injection moulding, a second polymeric element comprising a lower part of the external wall of the motor housing comprising the blower chamber.

The electric motor arranged to drive the blower, may be arranged for being powered by a power output from the public electric network (e.g. 115 V/230 V), or an electric motor arranged for beeing powered by a battery, e.g. a lithium-ion battery. Especially, the electric motor may be a DC type motor, e.g. a brush type electric motor. Alternatively, the electric motor may be an AC type motor, such as an induction type electric motor, and wherein a controller comprises a frequency converter circuit arranged to control the electric motor, so as to adjust flow and/or suction pressure.

In a fourth aspect, the invention provides data allowing the motor housing according to the first aspect to be manufactured on a manufacturing device, such as a 3D printing device.

It is appreciated that the same advantages and embodiments described for the first aspect apply as well for the further aspects. Further, it is appreciated that the described embodiments can be intermixed in any way between all the mentioned aspects.

BRIEF DESCRIPTION OF THE FIGURES

The invention will now be described in more detail with regard to the accompanying figures of which

The figures illustrate specific ways of implementing the present invention and are not to be construed as being limiting to other possible embodiments falling within the scope of the attached claim set.

DETAILED DESCRIPTION OF EMBODIMENTS

Figure 1:
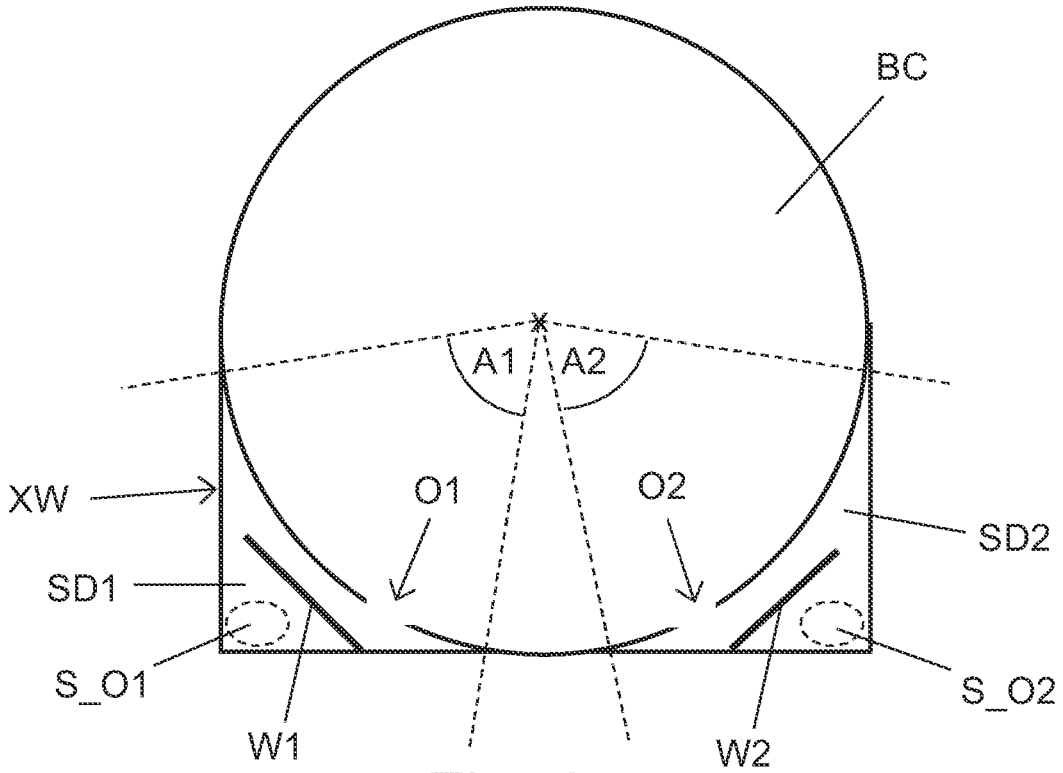
FIGS. 1-3 illustrate top view sketches of three different embodiments with different configurations of two silencer ducts around a circular motor and blower chamber.

FIG. 1 shows a top view sketch of an embodiment of a motor housing iment arranged to house a motor and a blower for generating an air flow in a cleaning device, such as a vacuum cleaning device, a floor cleaning device or a high pressure cleaning device. The motor housing comprises an external wall XW for enclosing a blower and a motor for driving the blower. The blower is arranged to rotate around an axis, and in the view in FIG. 1, which is a view parallel with said axis, i.e. a cross section view perpendicular to the axis x, only the centre of the axis is seen and indicated by 'x'. Thus, as seen the rotation axis x of the blower is arranged for being positioned in a central portion of the motor housing, referring to the view in FIG. 1.

The motor housing further encloses a flow passage between an externally accessible flow inlet and an externally accessible flow outlet, none of the are visible in view of FIG. 1. Still referring to the view in FIG. 1, the flow passage comprises a blower chamber BC, and first and second silencer ducts SD1, SD2. The blower chamber BC is arranged for housing the blower, and the blower chamber BC has an opening fluidically connected to the externally accessible flow inlet, e.g. directly via an opening in the top surface part of the external wall XW of the motor housing. Further, the blower chamber BC further has separate first and second outlet openings O1, O2 through its generally circular shaped outer wall to the adjacently positioned respective silencer ducts SD1, SD2.

The first silencer duct SD1 is arranged in a first area limited by a first angle A1 of less than 90° from the axis x, in the Fig. A1 is seen to be such as 80°-85°. A wall W1 between the blower chamber BC and the external wall XW of the motor housing serves to cause at least one flow direction bend of 180°, or at least about 180°, from the blower chamber output O1 to a first outlet opening S_O1 of the first silencer duct. This first outlet opening S_O1 is indicated by a dashed line, since it is located below the view shown in FIG. 1. In a preferred embodiment, the blower chamber BC and the first blower chamber output O1 is arranged in an upper part of the motor housing, while the first outlet opening S_O1 of the first silencer duct SD1 is arranged on a lower part, such as a bottom surface, of the exernal wall XW of the motor housing. Preferably, the first silencer duct SD1 occupies the entire extension of the motor housing from its bottom to its top, i.e. in a direction parallel with the axis x. Thus, a substantial volume is avaibale to generate a noise attenuating resonator chamber effect, together with the labyrinth bending effect provided by the wall W1, in this embodiment shown as a place shaped wall parallel with the axis x. Further, wall elements like wall W1 may be designed to provide quarter wavelength resonator effects to attenuate tonal noise from the blade frequency of the blower when operating at its normal rotation speed.

A second silencer duct SD2 fluidically connected to the second outlet opening O2 of the blower chamber BC is arranged in a second area limited by a second angle A2. Preferably, the first and second silencers are identical, or very close to identical, seen from an acoustic point of view. I.e. the second silencer duct SD2 preferably has a configuration similar to the first silencer SD1, which is preferred to provide a high noise attenuation, since effectively the fluid flow from the blower chamber BC is split into two parallel flow paths. Thus, the explanation above for the first silencer duct SD1 applies with respect to the angle A1, the wall W2, and the outlet opening S_O2 of the second silencer duct SD2 as well. However being non-overlappint, i.e. being angularly distributed, seen from the axis x, the first and second silencer ducts SD1, SD2 provides a high efficiency with respect to utilizing space available for silencing due to their limited angular extension of less than 90°, respectively.

As seen, the outer dimensions are compact, since the external wall XW forms the wall of half of the circular shaped blower chamber BC, and also in a smaller part located between the first and second silencer ducts SD1, SD2. The silencer ducts SD1, SD2 occupy the space in the corners of the rectuangular shaped external wall portion XW of the motor housing. It is understood that the two silencer ducts SD1, SD2 may have been angularly distributed differently with respect to each other, thus resulting in a different outer shape of the external wall of the motor housing, but still within the scope of invention.

Figure 2:
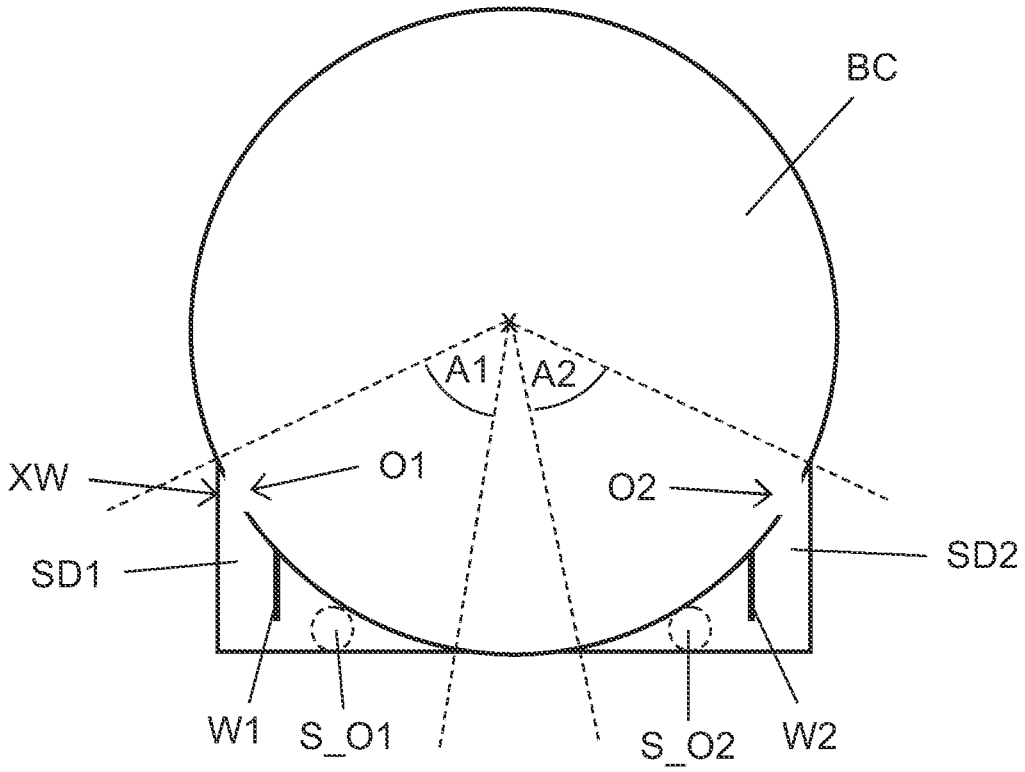

FIG. 2 shows a variant of the embodiment of FIG. 1, still with the corner position of the two similarly configured silencer ducts SD1, SD2, but in FIG. 2 with a smaller angular extension A1, A2 of such as 50°-60°. Thus with smaller volumes for silencing effect, the outer shape can be even more compact, since here the external wall XW of the motor housing forms more than half of the circular shaped blower chamber BC. A further difference from FIG. 1 is the location of blower chamber openings O1, O2, the location of the outlets S_O1, S_O2, and the configurations of the plane walls W1, W2 which are positioned differently compared to FIG. 1 the angular, and thus result in other flow direction paths than in FIG. 1.

Figure 3:
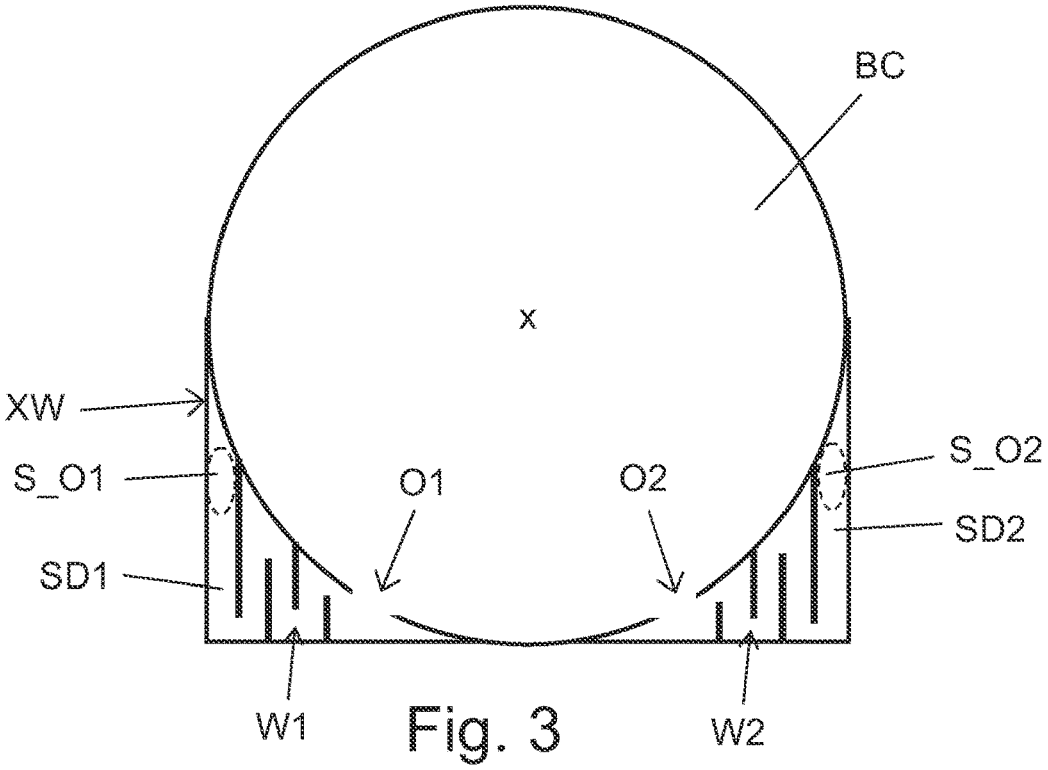

FIG. 3 is yet another variant of the embodiments of FIGS. 1 and 2. The outer shape is similar to FIG. 1, but the location of the outlets S_O1, S_O2 is different. Further, in this embodiment, a plurality of separate plane walls W1, W2, specifically four wall elements, are arranged to provide a labyrinth effect with several flow direction bends between blower chamber outlets O1, O2 and outlets of the silencer ducts SD1, SD2.

FIGS. 1-3 only serve to illustrate a few variants of the concept of non-overlapping angularly limited, preferably similarly configured, parallel silencer ducts.

In the following, referreing to skethes in FIGS. 4-9, and photos in FIGS. 10-13, a specific square box shaped motor housing embodiment suited for a floor cleaning device with a vacuum suction system will be described.

Figure 4:
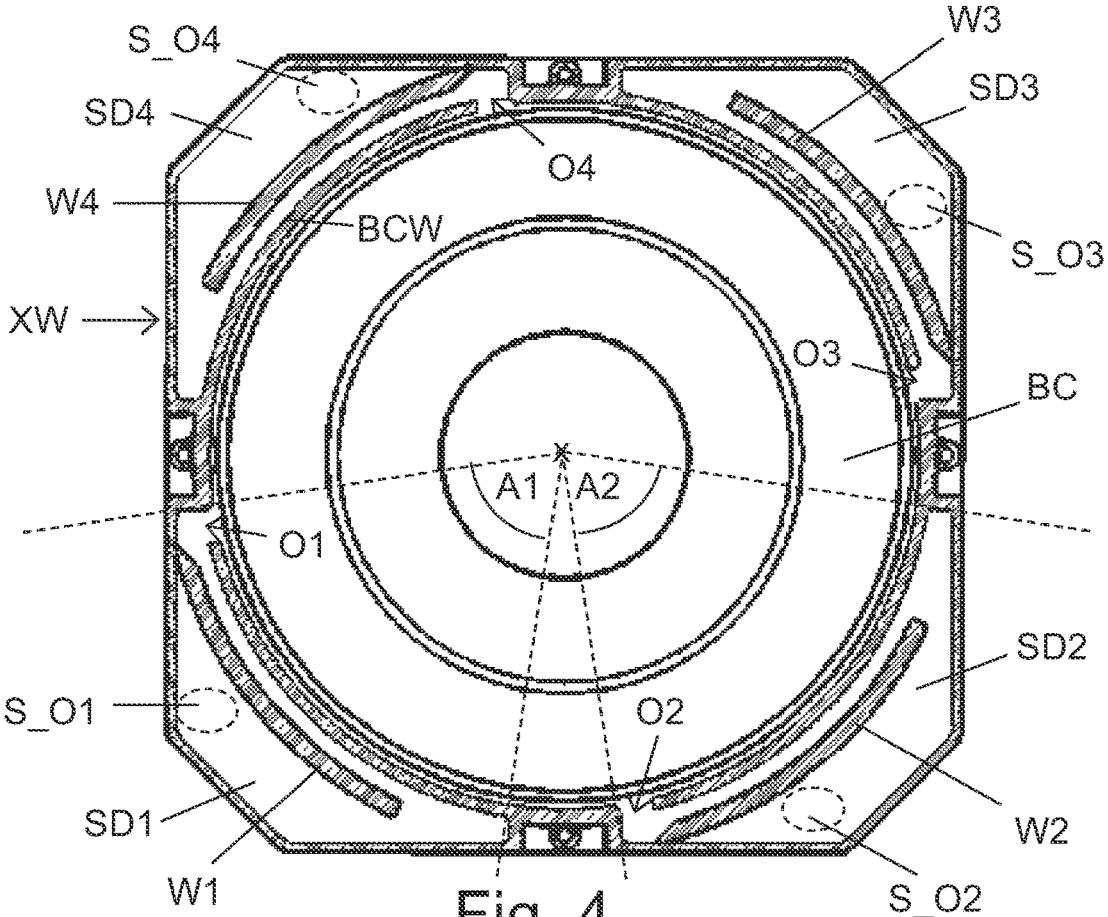
FIG. 4 shows a top view sketch of an embodiment with four silencer ducts around a circular motor and blower chamber.

FIG. 4 shows a top view sketch of this specific embodiment, having with four identical or at least practically identical silencer ducts SD1, SD2, SD3, SD4 distributed angularly around a circular blower chamber B. At least the silencer ducts SD1, SD2, SD3, SD4 have similar or substantially similar configurations with respect to silencing. Only angular extensions A1, A2 of the first and second silencer ducts are show for clarity reasons, however all of the silencer ducts occupy angles of such as 75°-85°.

The general shape of the external wall XW of the motor housing is square, seen in a view parallel with the axis x, but with the corners cut off. This provides a high utilization of space available in combination with the fact that, as seen, the circular blower chamber BC extends at four points or positions to the external wall XW of the motor housing, located between the silencer ducts SD1, SD2, SD3, SD4. The blower chamber outlet openings O1, O2, O3, O4 are located in the blower chamber wall BCW adjacent to these points or positions, wherein the blower chamber wall BCW and the external wall XW of the motor housing meet.

The silencer duct outlet openings S_O1, S_O2, S_O3, S_O4 are located near the corner positions of the motor housing, and in a bottom part of the motor housing, as also explained in connection with FIG. 1, and curved walls W1, W2, W3, W4 parallel with the circular shaped outer wall BCW of the blower chamber BC serves to provide flow direction bends to generate noise attenuation effects.

Figure 5:
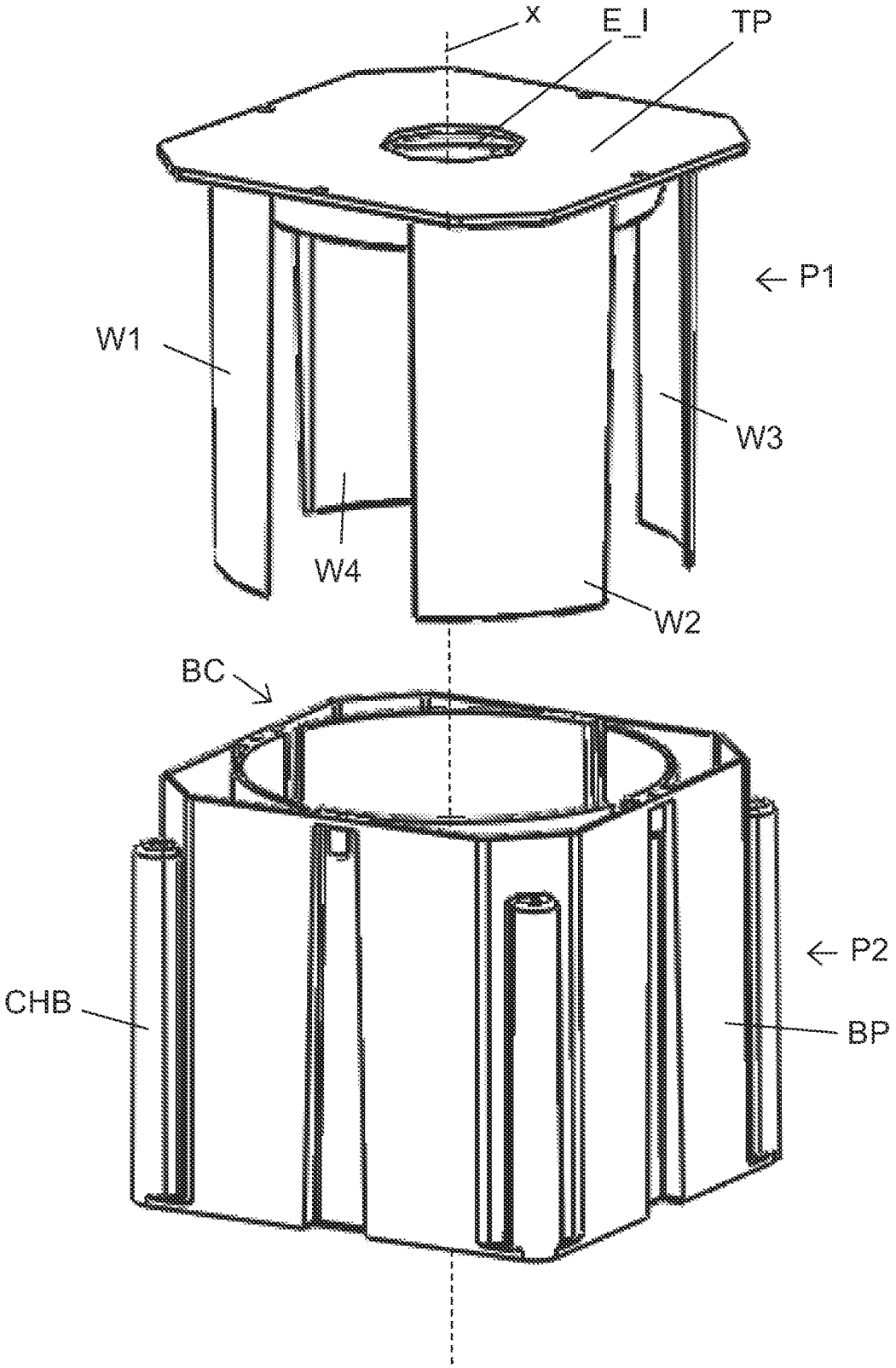
FIGS. 5-9 show different views of the embodiment with four silencer ducts around a circular motor and blower chamber.

FIG. 5 shows a 3D view of the embodiment of FIG. 4, where it is seen that the motor housing is constituted by first and second separate monolithic polymeric elements P1, P2 arranged for being assembled. The first separate polymeric element P1 comprises a top surface part TP of the motor housing external wall, a flat top or lid serving as upper wall of the blower chamber BC, and structurally connected to the full extension parallel with axis x of the walls W1, W2, W3, W4 of the respective four silencer ducts. The externally accessible flow inlet E_I of the motor housing is seen as a circular opening in the centre of the top surface part TP.

The second separate polymeric element P2 comprises a bottom part BP of the motor housing which forms the raiming part of the motor housing, i.e. including a bottom surface and side walls extending parallel or substantially parallel with the axis x. Further, in the corner positions of the bottom part BP, channels CHB are positioned for receiveing bolts of the like for fastening the motor housing to parts of a device, e.g. cleaning device. The externally accessible flow outlet of the motor housing is not visible in FIG. 5, i.e. the four outlets of the respective silencer ducts, as these are positioned on the flat lower surface part of the bottom part BP of the motor housing.

By splitting all elements into two polymeric elements P1, P2, it is possible to manufacture the entire motor housing using only two element, and by placing the walls W1, W2, W3, W4 on the first polymeric element P1, the inner parts of the motor housing has dimensions large enough to allow injection moulding of both elements P1, P2 even in the rather compact embodiment shown which has a square top view with side lengths of 15.5 cm and a height of 14.5 cm.

Figure 6:
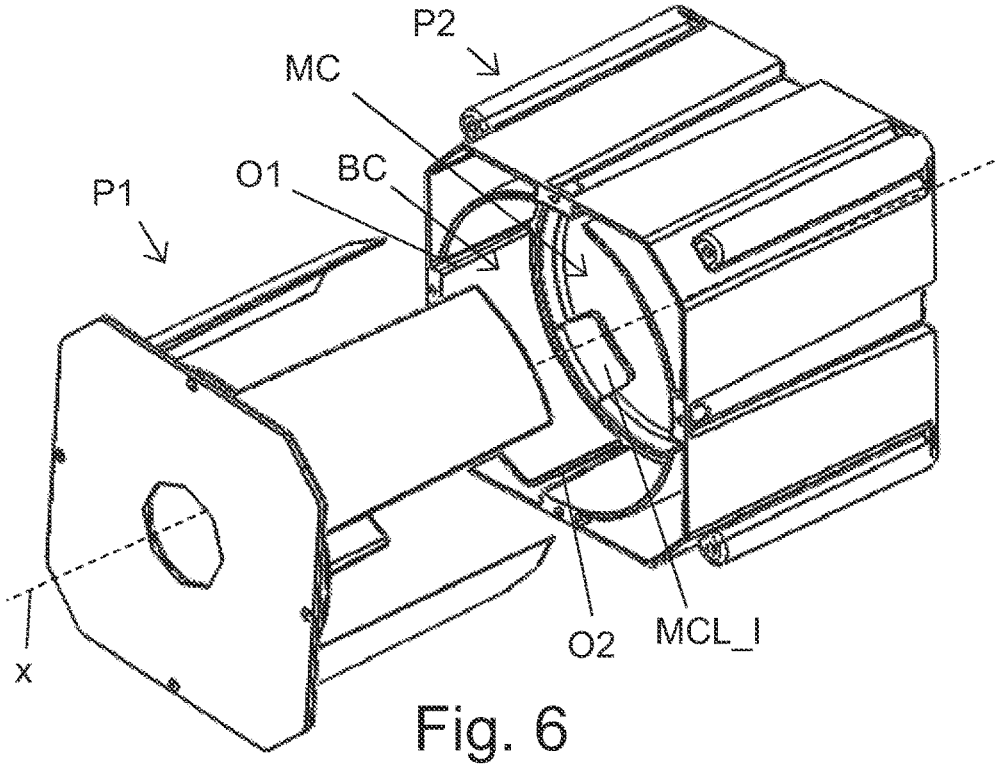

It is understood that in motor housing embodiments with larger dimensions, it may be possible to injection moulded with the walls W1, W2, W3, W4 integrated in the bottom part P2, but still the splitting at least a part of the walls of the silencer ducts into a separate element may allow injection moulding of rather complicated labyrinth silencer designs with narrow flow paths. E.g. this may also facilitate FIG. 6 shows the same two elements P1, P2 as in FIG. 5, but in a different view. Here, a part of the blower chamber BC is visible with two of its outlets O1, O2 as seen in the form of slids extending in the direction parallel with the axis x. Below the blower chamber BC, the motor chamber MC is located. These chambers BC, MC are sealed by a water-tight sealing to avoid liquid or moist penetrating from the blower chamber BC into the motor chamber MC. The motor chamber MC has a separate cooling air inlet and outlet on the bottom surface of the bottom part, thus not visible in FIG. 6, but the inlet opening MCL_I from an annular passage for cooling air into the motor chamber MC is visible.

Figure 7:
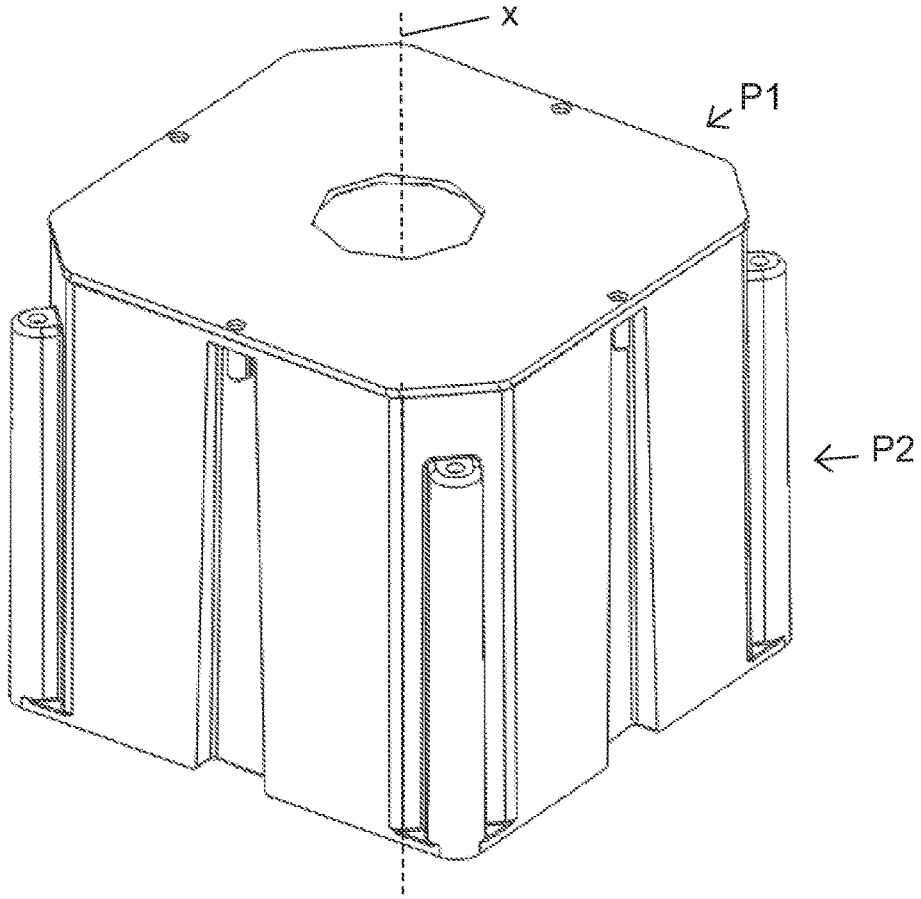

FIG. 7 shows the two elements P1, P2 in an assembled state.

Figure 8:
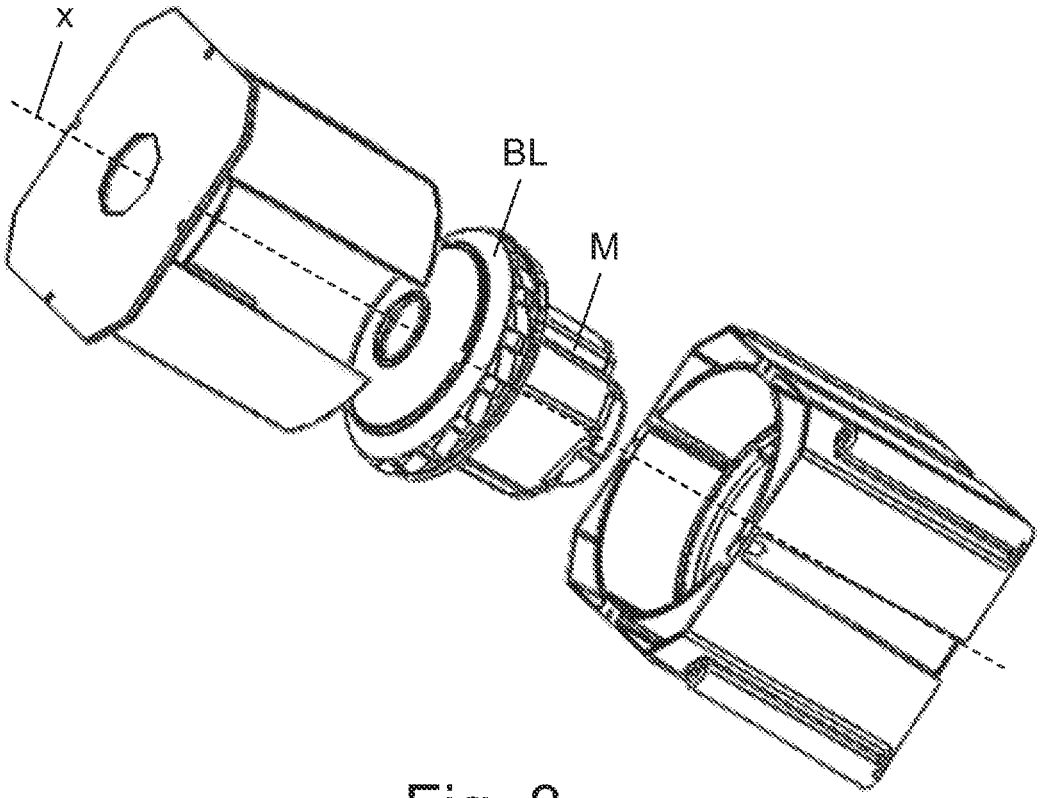
Figure 9:
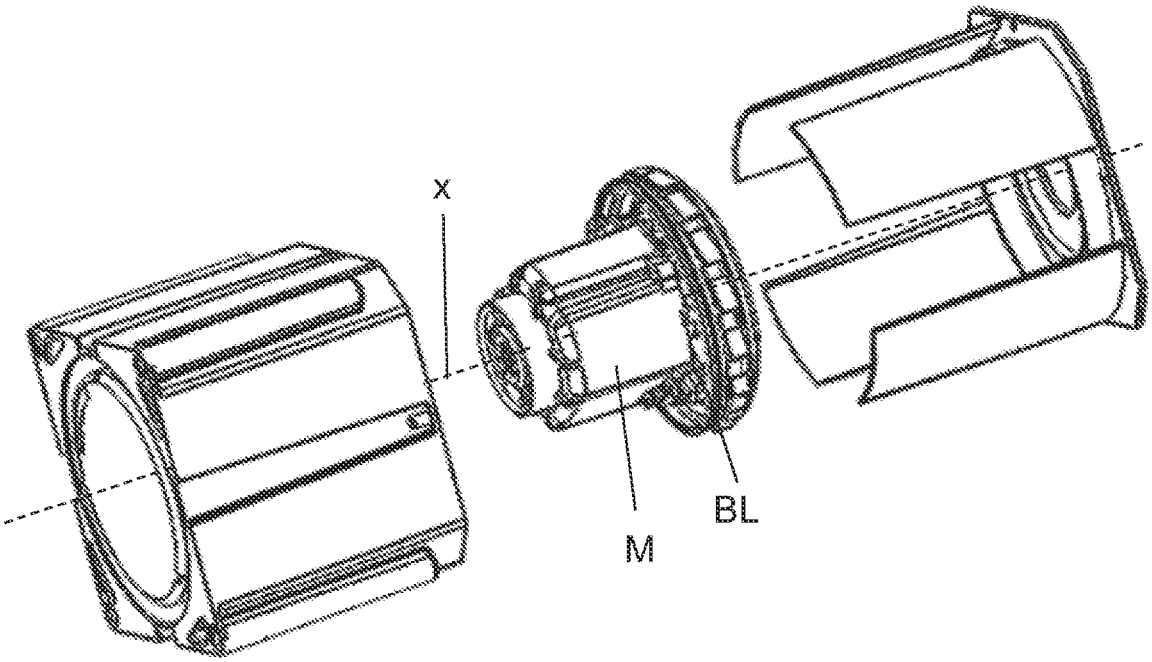

FIGS. 8 and 9 show different exploded views of the motor housing with the motor M and blower BL visible. The motor M and blower BL are arranged to rotate around one common axis, namely axis x. The plane bottom part of the external wall of the motor housing is at least partly visible in FIG. 9. The end of the motor M opposite the blower BL comprises a cooling fan for cooling the motor M.

Figure 10:
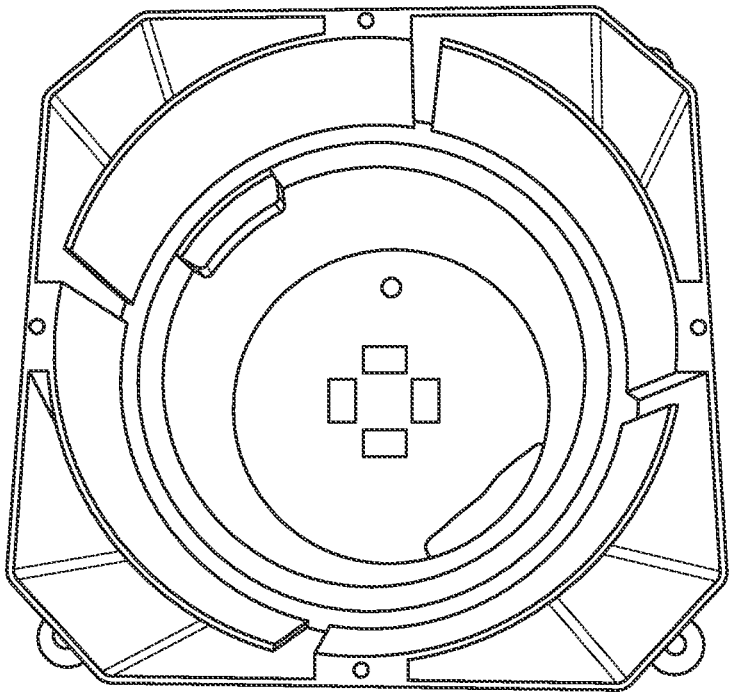
FIGS. 10-13 show different photos of a prototype similar to the embodiment shown in FIGS. 4-9.
Figure 11:
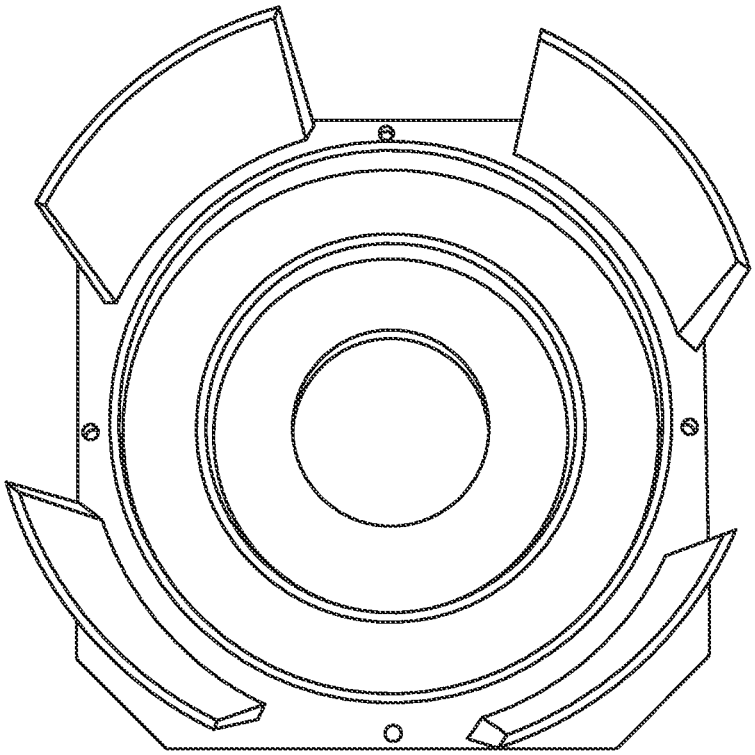

FIGS. 10-13 show different photos of a prototype similar to the embodiment shown in FIGS. 4-9. FIG. 10 shows a top view similar to the view in FIG. 4. FIG. 11 shows a bottom view of the upper part of the motor housing including the walls.

Figure 12:
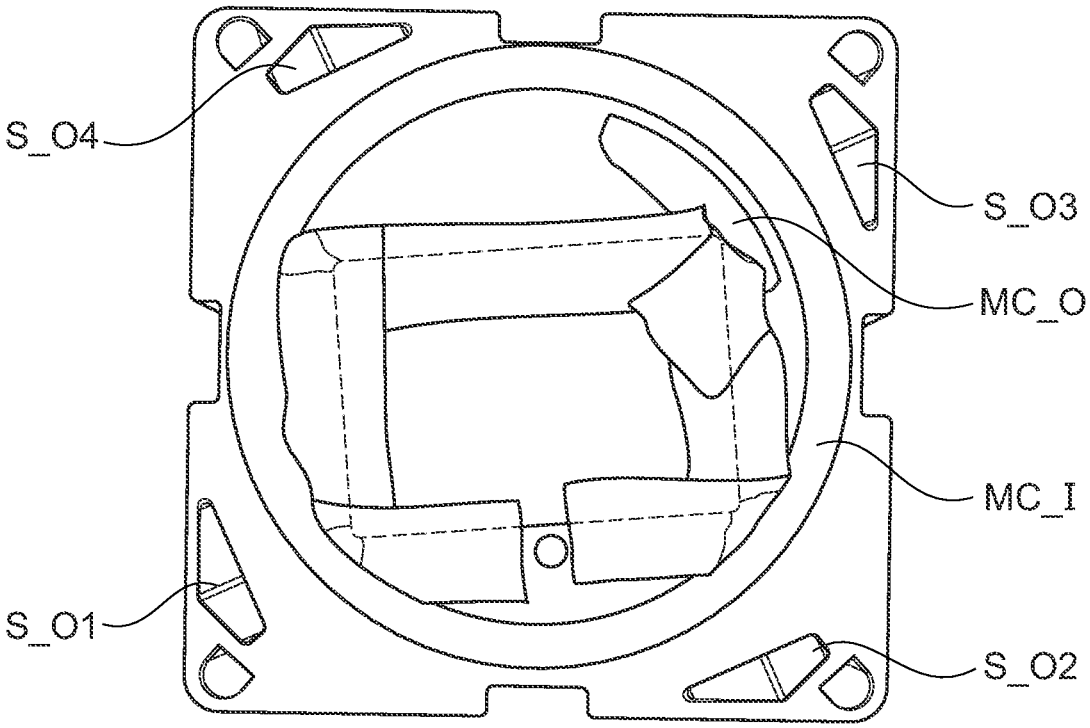

FIG. 12 shows a bottom view of the motor housing, i.e. the bottom surface part of the external wall of the motor housing. Here, four outlet openings S_O1, S_O2, S_O3, S_O4 from the respective silencer ducts are seen and located at respective separate positions on the bottom surface part of the motor housing, so as to constitute the externally accessible flow outlet. It is to be understood that other locations on the external wall of the motor housing may be preferred for being applied in a differently configured cleaning device. Further, the bottom surface part of the motor housing comprises a motor cooling inlet MC_I shaped as an annular opening and connected to the motor chamber via an annular channel, see FIG. 6 for cooling air connection to the motor chamber driven by a fan on the motor. Further, the bottom surface part of the motor housing comprises a motor cooling air outlet MC_O which is seen to be shaped as a slid located in an area within the annular inlet opening MC_I.

Figure 13:
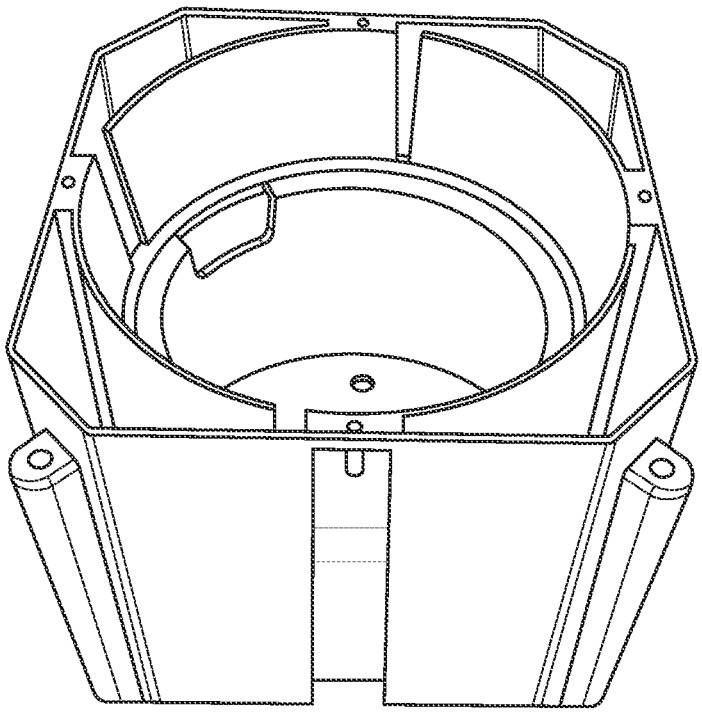

FIG. 13 shows a photo with another view of the bottom part of the motor housing.

Figure 14:
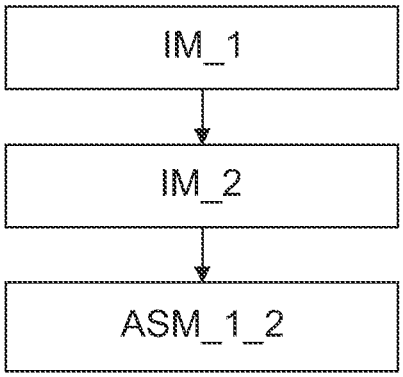
FIG. 14 shows steps of a method of manufacturing embodiment.

FIG. 14 shows steps of a method of manufacturing a motor housing embodiment, such as motor housing embodiment described in the foregoing. In one step IM_1 the method comprises manufacturing a first polymeric element in an injection moulding process, wherein the first polymeric element comprises a motor a top surface part of the external wall of the motor housing, and at least one wall between the blower chamber and the external wall of the motor housing of both of the first and second silencer ducts. In a second step IM_2, the method comprises manufacturing a second polymeric element comprising a lower part of the external wall of the motor housing comprising one or more walls defining the blower chamber. Finally, the first and second polymeric elements are assembled ASM_1_2.

To sum up: the invention provides a compact motor housing for housing a motor and a blower of a cleaning device and with integrated air outlet silencing. The motor housing encloses a flow passage between a flow inlet and outlet. The housing has a blower chamber fluidically connected to the flow inlet, and via first and second outlet openings also fluidically connected to at least two parallel, preferably similar, silencer ducts each being arranged in an area limited by an angle of less than 90°, seen in a view parallel with the blower and motor axis. The silencer ducts each have at least one wall between the blower chamber and the external wall of the motor housing for causing at least one flow direction bend, so as to provide a noise attenuating effect. The areas occupied by the at least two silencer ducts are non-overlapping, seen in a view parallel with the blower and motor axis. With a circular blower chamber, a compact box shaped motor housing can be provided with corner volumes available for silencer ducts.

Although the present invention has been described in connection with the specified embodiments, it should not be construed as being in any way limited to the presented examples. The scope of the present invention is to be interpreted in the light of the accompanying claim set. In the context of the claims, the terms "including" or "includes" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A motor housing for housing a motor and a blower of a cleaning device, the motor housing comprising an external wall for enclosing a blower arranged to rotate around an axis, a motor for driving the blower, and a flow passage between an externally accessible flow inlet and an externally accessible flow outlet, wherein the flow passage comprises, seen in a view parallel with said axis:

a blower chamber for housing the blower, wherein the blower chamber has an opening fluidically connected to the externally accessible flow inlet, wherein the blower chamber further has separate first and second outlet openings, a first silencer duct fluidically connected to the first outlet opening of the blower chamber, wherein the first silencer duct is arranged in a first area limited by a first angle of less than 90° from the axis, wherein at least one wall between the blower chamber and the external wall of the motor housing serves to cause at least one flow direction bend, and wherein the first silencer duct has a first outlet opening, and a second silencer duct fluidically connected to the second outlet opening of the blower chamber, wherein the second silencer duct is arranged in a second area limited by a second angle of less than 90° from the axis, wherein at least one wall between the blower chamber and the external wall of the motor housing serves to cause at least one flow direction bend, and wherein the second silencer duct has a second outlet opening, wherein the first and second areas are non-overlapping.

2. The motor housing according to claim 1, comprising a third silencer duct fluidically connected to a third outlet opening of the blower chamber, wherein the third silencer duct is arranged in a third area limited by a third angle of less than 90° from the axis and non-overlapping with the first and second areas, wherein the third silencer duct has a third outlet opening.

3. The motor housing according to claim 2, comprising a fourth silencer duct fluidically connected to a fourth outlet opening of the blower chamber, wherein the fourth silencer duct is arranged in a fourth area limited by a fourth angle of less than 90° from the axis and non-overlapping with the first, second and third areas, wherein the fourth silencer duct has a fourth outlet opening.

4. The motor housing according to claim 1, having a general rectangular or substantially rectangular shape, seen in a view parallel with said axis.

5. The motor housing according to claim 1, wherein the blower chamber has a circular or substantially circular shaped outer wall, seen in a view parallel with said axis, in which the first and second openings are arranged.

6. The motor housing according to claim 1, wherein, seen in a view parallel with said axis, the blower chamber extends at least at one point to the external wall of the motor housing.

7. The motor housing according to claim 1, wherein the externally accessible flow inlet is arranged on a top surface part of the external wall of the motor housing.

8. The motor housing according to claim 1, wherein a first part of the external wall of the motor housing forms part of the first silencer duct, and wherein a second part of the external wall of the motor housing forms part of the second silencer duct.

9. The motor housing according to claim 1, wherein the motor housing is constituted by first and second separate polymeric elements arranged for being assembled, wherein the first separate polymeric element comprises a top surface part of the external wall of the motor housing and the at least one wall of both of the first and second silencer ducts.

10. The motor housing according to claim 1, wherein said at least one wall between the blower chamber and the external wall of the motor housing of both of the first and second silencer ducts serve to cause at least one flow direction bend of 90°-180°.

11. The motor housing according to claim 1, wherein both of the first and second silencer ducts comprise at least one wall element dimensioned to act as a quarter wavelength resonator to reduce tonal noise from the blower.

12. The motor housing according to claim 1, wherein both of the first and second silencer ducts extend, in a direction along said axis, from the bottom to the top of the motor housing.

13. A cleaning device for generating an air flow for vacuuming or high pressure cleaning dirt, comprising a motor housing according to claim 1.

14. A method for manufacturing the motor housing according to claim 1, comprising manufacturing a first polymeric element comprising motor a top surface part of the external wall of the motor housing and said at least one wall between the blower chamber and the external wall of the motor housing of both of the first and second silencer ducts, and manufacturing a second polymeric element comprising a lower part of the external wall of the motor housing comprising the blower chamber.

* * * * *